United States Patent [19]

Pettitt

[11] 4,061,225

[45] Dec. 6, 1977

[54] TOOL FOR THE INSERTION OF THUMB TACKS

[76] Inventor: George F. Pettitt, 32 Carlson Parkway, Cedar Grove, N.J. 07009

[21] Appl. No.: 633,793

[22] Filed: Nov. 20, 1975

[51] Int. Cl.[2] ..... B65D 69/00; B65D 85/24

[52] U.S. Cl. ..... 206/230; 227/147; 145/46; 206/818; 206/338

[58] Field of Search ..... 294/63.5; 227/147; 145/46; 206/230, 818, 231, 338, 340, 343

[56] References Cited

U.S. PATENT DOCUMENTS

| | | | |
|---|---|---|---|
| D. 222,087 | 9/1971 | Hagopian | 206/818 |
| 493,758 | /1893 | Davidson | 145/46 |
| 1,127,838 | 2/1915 | Willers | 227/147 |
| 2,475,450 | 7/1949 | Dvorak | 206/818 |
| 3,160,270 | 12/1964 | Werstein | 206/230 |

*Primary Examiner*—William Price
*Assistant Examiner*—Douglas B. Farrow
*Attorney, Agent, or Firm*—Kenyon & Kenyon, Reilly, Carr & Chapin

[57] ABSTRACT

A tool for inserting thumb tacks comprising a handle having a neck-down portion near its one end with a recess in that end containing a magnet therein permitting picking up a thumb tack and holding it in a position for insertion, the neck-down portion of the tool permitting applying thumb pressure. The other end of the tool is rounded to allow application of additional pressure, if needed, with the heel of the hand. Also disclosed is a container for holding the thumb tacks in a manner that they can be easily picked up and also including a recess for the tool.

2 Claims, 4 Drawing Figures

TOOL FOR THE INSERTION OF THUMB TACKS

BACKGROUND OF THE INVENTION

This invention relates to thumb dispensing and insertion tools in general, and more particularly to an improved thumb tack insertion tool and container for thumb tacks.

As their name implies, thumb tacks are normally meant to be inserted using thumb pressure without any additional tools. However, it is evident to all those who have used thumb tacks that in cases where great numbers of thumb tacks must be inserted or where thumb tacks must be inserted into a hard material, the user can very quickly develop a sore thumb. For example, thumb tacks are used by many housewives in arranging curtains or the like with ties. When such thumb tacks are inserted into the hard wood of a window frame there is a great deal of force required which can lead to the development of such a sore thumb.

Various dispensers have been developed for thumb tacks. However, they still allow the user to use thumb pressure for insertion. For example, a tack holder and setting tool is disclosured in U.S. Pat. No. 3,250,308. There, the tacks reside in a slot and the tool simply give the user a greater area on which he can apply the pressure. In a related area, various magnetic tools have been developed in setting or driving carpet tack, upholstery tacks and the like. For example, in U.S. Pat. No. 608,555 a magnetic tack driver which includes a magnet and a tube for aligning the tack prior to driving is illustrated. U.S. Pat. No. 3,286,821 discloses a tack receptacle and dispenser for use for use with a magnetic hammer such as is used in upholstery work. However, none of these devices are easily adaptable to use with a thumb tack which is meant to be inserted with hand pressure rather than by a hammer.

Thus, the need for a device to permit inserting thumb tacks using the hand but in such a manner that the inserter does not end with a sore thumb evident.

SUMMARY OF THE INVENTION

The present invention provides such a thumb tack insertion tool. The tool essentially comprises a handle of rotational symmetry having an enlarged ball-like end to fit in the palm with a neck-down section flaring out near its base to permit the application of thumb pressure. At the end, adjacent the flared out section, is a truncated conical section having a recess in its end. In the recess a magnet is permanently attached to the tool slightly below the edge thereof. The magnet is of cylindrical shape and has a diameter close to that of the diameter of a thumb tack head. The thumb tack is picked up by the magnet and resides attached thereto with its head slightly within the remaining recess on the end of the tool. The tool with the tack held in place by the magnet is then moved to the place where the tack is to be used with the user inserting the tack applying pressure to the flared section with his thumb and forefinger and to the rounded end of the tool with his palm as necessary. In this way he can use his whole hand to get the application pressure necessary and does not end up with a sore thumb.

Also disclosed is a container for tacks and the tool when not in use. This container comprises a box having a bottom portion and a cover portion. Within the box is a styrofoam insert essentially filling the whole box except for a central opening cut out in a size and shape to fit the insertion tool. The remainder of the styrofoam contains a plurality of holes having a diameter slightly greater than the diameter of the shank of a thumb tack. Each hole has a thumb tack placed therein. When the cover is placed over the styrofoam insert with the tacks therein it rests essentially at the top of the thumb tack heads to retain them in place and prevent them from falling out of the holes in the styrofoam.

Preferably, the insertion tool is molded of plastic with the magnet held in place by a suitable adhesive such as an epoxy. Similarly, the box can be a molded box of, for example, 1/16 inch plastic. Although styrofoam is the preferred material for filling the box, other suitable materials can also be used.

DETAILED DESCRIPTION OF THE PREFERRED EMBODIMENT

Figure 1:
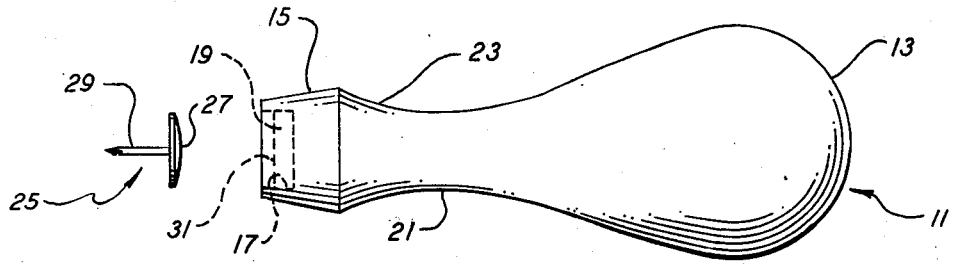
FIG. 1 is a plan view of the insertion tool of the present invention.
Figure 2:
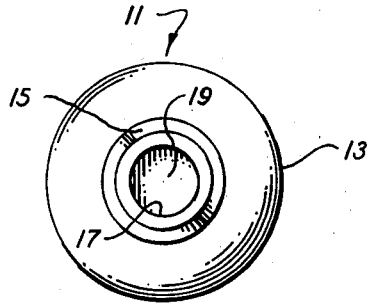
FIG. 2 is an end view of the tool of FIG. 1.

The thumb tack insertion tool of the present invention is shown on FIGS. 1 and 2 indicated generally as 11. The tool has a body which has a rotational symmetry. The outer end of the handle designated as 13 has a shape which is rounded much in the manner of the handle of an awl. i.e. it has an elarged ball-like end. At the other end of the tool is a truncated conical section 15 having a recess 17 into which is inserted a magnet 19 held in place by a suitable adhesive such as epoxy. Between the ends 15 and 13 is a narrowed, neck-down section 21 which flares out toward the base of the conical section 15. This shape permits applying pressure with the thumb and index finger on the ridge 23 to aid in inserting the tack. In addition, if further force is necessary, the palm can be pushed against the portion 13 of the tool 11. Also shown on FIG. 1 is a tack 25 having a head 27 and shank 29. The top 31 of the magnet 17 is preferably recessed below the end of the tool an amount which is essentially equal to the thickness of the head 27. Thus, once the tack is in place it will remain properly aligned.

Figure 4:
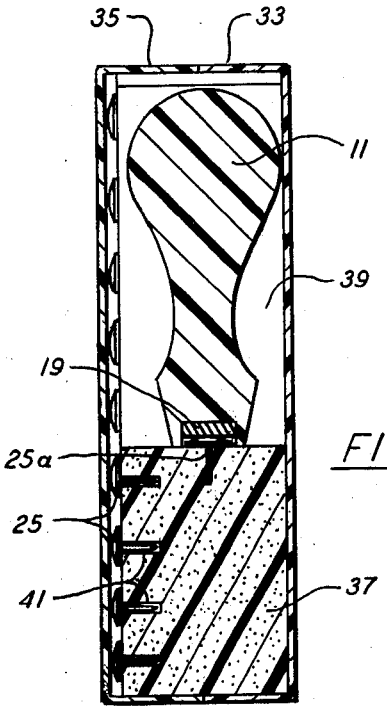
FIG. 4 is a cross-sectional view of the box of FIG. 3.
Figure 3:
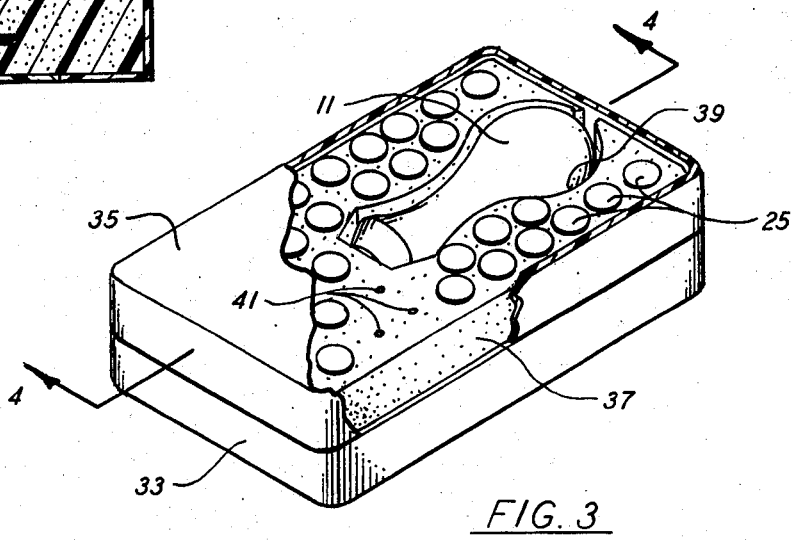
FIG. 3 is a perspective view of a plastic box for holding the tool of FIGS. 1 and 2 and a plurality of thumb tacks.

FIGS. 3 and 4 illustrate a box for holding the tool of FIGS. 1 and 2 and a plurality of tacks. The box comprises essentially a two piece plastic box. Typical dimensions of the box 4 can be three inches wide by 1⅝ inches high by 5¾ inches long. A typical box will have wall thicknesses of 1/16 inch. Placed inside and filling the base 33 of the box and extending almost to a height equal to that of the top 35 of the box is a styrofoam insert 37. Although styrofoam is preferred, other materials may also be used. As shown on FIG. 3, the styrofoam insert 37 has a cut-out 39 into which the tool 11 can be inserted and reset when the tool is not in use. A plurality of holes 41 are made in the styrofoam, the holes having a diameter greater than that of the shank 29 of a thumb tack. As shown on FIGS. 3 and 4, thumb tacks are inserted into these holes to provide a supply of tacks. As is evident from FIG. 4, with the top 35 on the box, the thumb tacks can not fall out of place since the top will be resting essentially against the tacks. When the tool is to be used, it is only necessary to remove the top 25, take the tool 11 out of its recess and plate it over a tack whereupon the tack will be picked up and held by a magnet for ease of insertion. Once the tack is inserted with the tool 11, the frictional force holding its shank in place will exceed the force exerted by the magnet 17 and the tool can simply be pulled away and used to pick up another tack for insertion.

Preferably a tack 25*a* is secured in the styrofoam insert 37 so as to contact the magnet 17 to prevent loss of magnetization when the tool rests in the box as shown on FIG. 4.

Although the tool can be made of essentially any material, it lends itself particularly well to molding of a hard plastic. In such a case, the magnet which will be a small cylindrical magnet of the general type used for keeping notes on a refrigerator or the like will be glued into place using a suitable adhesive such as epoxy.

Thus, a tool particularly useful for saving wear and tear on the thumb when inserting thumb tacks has been shown. Although a specific embodiment has been illustrated and described, it will be obvious to those skilled in the art that various modifications may be made without departing from the spirit of the invention which is intended to be limited solely by the appended claims.

I claim:

1. A thumb tack insertion means comprising:

a. a tool for inserting a thumb tack including:

1. a base which is rotationally symmetric and has an enlarged rounded portion at one end and a truncated conical section at the other end with a necked-down portion therebetween to form a flared portion of a size permitting the application of thumb and finger pressure, the rounded portion being of a size and spaced therefrom so as to permit palm pressure to also be applied, said truncated conical portion containing a recess of a diameter slightly greater than the size of the head of a thumb tack; and 2. a thin cylindrical magnet havint its top disposed a small distance below the end of said base secured into said recess whereby a recess capable of retaining the head of the thumb tack will be provided; and b. means for holding said tool and a supply of thumb tacks including:

1. a plastic box having a top portion and a bottom portion;

2. a three dimensional solid styroform member sized to fit in said box, said stryform member containing a plurality of holes of a diameter greater than the diameter of the shank of a thumb tack, the thickness of said member being such that, when the top of said box is in place, tacks in said holes cannot fall out of said holes, said member also containing a cut-out of a size and shape to receive said tool, whereby said tool may be placed in said cut-out and the cover of said box put in place thereby providing a self-contained unit having both insertion tools and a plurality of tacks; and 3. a tack secured in said styroform so as to contact said magent when said tool is in said box.

2. The tool according to claim 1 wherein said base is made of plastic and said magnet is glued into place.

* * * * *